US007690543B1

(12) United States Patent
Edwards-Delgado et al.

(10) Patent No.: US 7,690,543 B1
(45) Date of Patent: Apr. 6, 2010

(54) TENNIS BALL HOLDER

(76) Inventors: Linda Edwards-Delgado, 8 Cambria St., #303, Clearwater Beach, FL (US) 33767; Tabitha Eiseman, 1667 Hobbit Rd., Dunedin, FL (US) 34698

( * ) Notice: Subject to any disclaimer, the term of this patent is extended or adjusted under 35 U.S.C. 154(b) by 221 days.

(21) Appl. No.: 11/974,053

(22) Filed: Oct. 11, 2007

(51) Int. Cl.
*A45F 3/00* (2006.01)

(52) U.S. Cl. ..... 224/677; 224/660; 224/919

(58) Field of Classification Search ..... 224/677, 224/919, 247, 673, 663, 681, 662, 676, 153, 224/660, 664, 680; D3/221, 226, 257; 206/315.9
See application file for complete search history.

(56) References Cited

U.S. PATENT DOCUMENTS 1,482,130 A * 1/1924 Griest ..... 224/576
3,212,690 A * 10/1965 Green ..... 224/576
4,072,256 A 2/1978 Young
4,096,929 A * 6/1978 Frey et al. ..... 383/4
D289,226 S * 4/1987 Zisholtz ..... D3/221
4,706,860 A 11/1987 Leider
4,836,427 A 6/1989 McManus
5,064,107 A 11/1991 Ascarrunz
5,289,960 A * 3/1994 Kelly et al. ..... 224/664
5,326,005 A * 7/1994 Fisher ..... 224/661
D394,348 S * 5/1998 Aliff ..... D3/238
6,216,933 B1 * 4/2001 Healy ..... 224/663
6,698,636 B2 * 3/2004 Angus et al. ..... 224/660
7,395,930 B2 * 7/2008 Tauchen ..... 206/579

* cited by examiner

*Primary Examiner*—Nathan J Newhouse
*Assistant Examiner*—Steven M Landolfi, Jr.

(57) ABSTRACT

A housing assembly is formed of a front sheet overlying a rear sheet with a curved periphery for the majority of the lower and upper extents of the housing assembly forming a passageway. A waist band with a clasp is secured by stitching to the upper edge of the housing assembly.

1 Claim, 3 Drawing Sheets

FIG 1
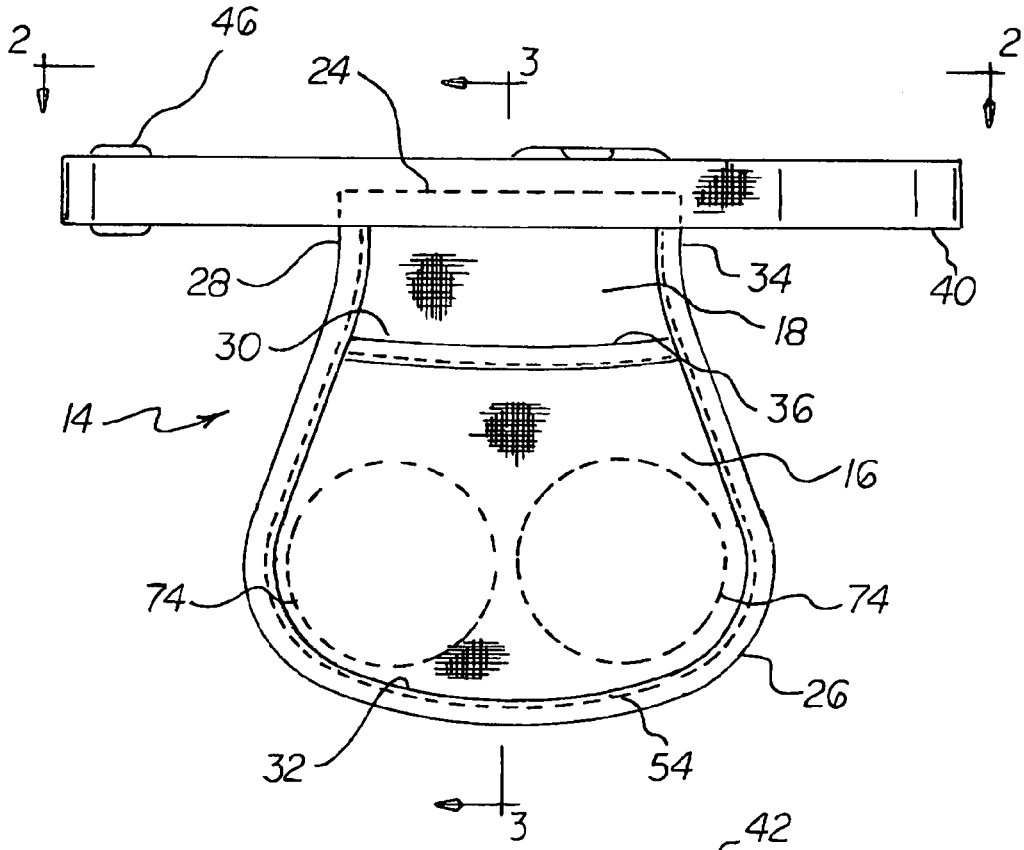
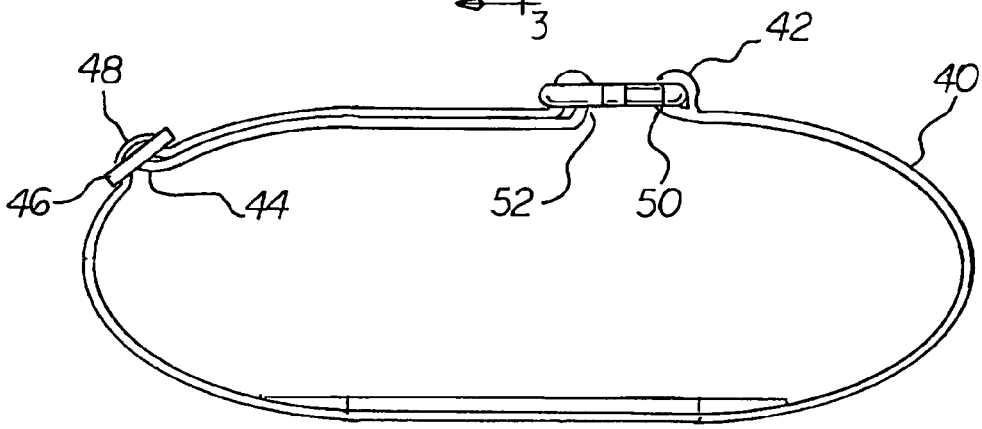
FIG 2

FIG 3
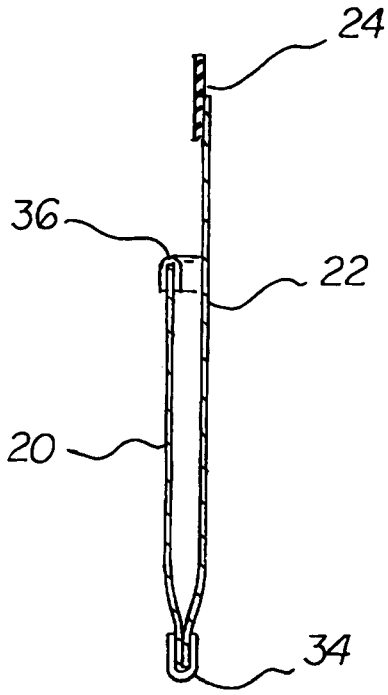
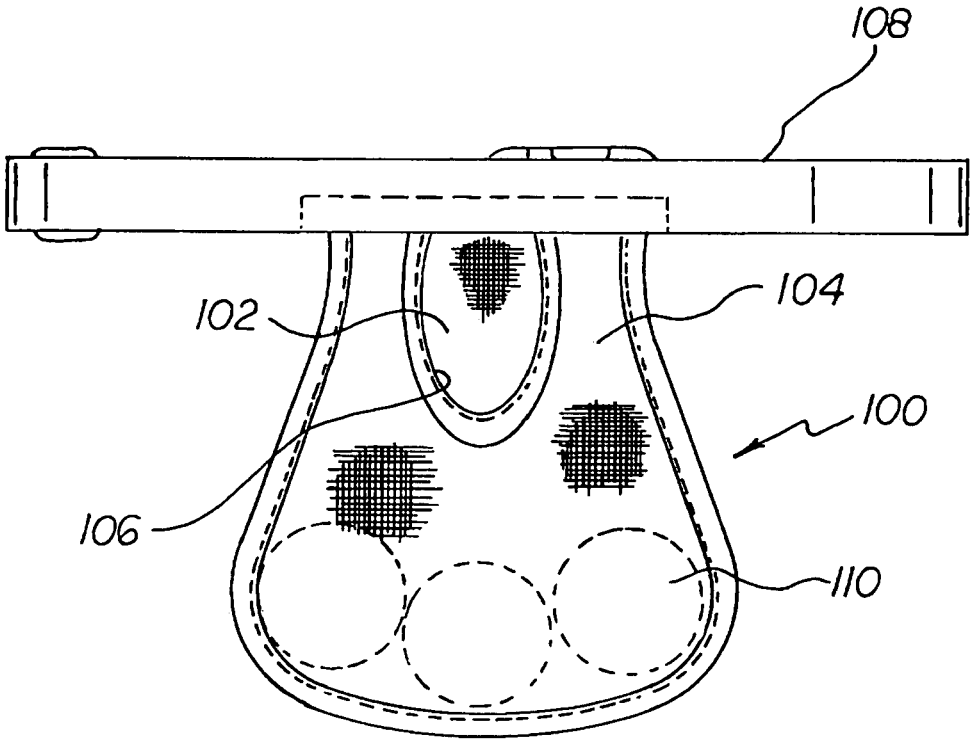
FIG 4

TENNIS BALL HOLDER

BACKGROUND OF THE INVENTION

1. Field of the Invention

The present invention relates to a tennis ball holder and more particularly pertains to removably retaining two tennis balls for ready use by a player in a safe, convenient and economical manner.

2. Description of the Prior Art

The use of game ball holders of known designs and configurations is known in the prior art. More specifically, game ball holders of known designs and configurations previously devised and utilized for the purpose of retaining game balls through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,072,256 issued Feb. 7, 1978 to Young relates to a Game Ball Holder. U.S. Pat. No. 4,706,860 issued Nov. 17, 1987 to Leider relates to a Ball Quiver. U.S. Pat. No. 4,836,427 issued Jun. 6, 1989 to McManus relates to a Tennis Utility Belt. Lastly, U.S. Pat. No. 5,064,107 issued Nov. 12, 1991 to Ascarrunz relates to a Tennis Ball Holder.

While these devices fulfill their respective, particular objectives and requirements, the aforementioned patents do not describe a tennis ball holder that allows for removably retaining two tennis balls for ready use by a player in a safe, convenient and economical manner.

In this respect, the tennis ball holder according to the present invention substantially departs from the conventional concepts and designs of the prior art, and in doing so provides an apparatus primarily developed for the purpose of removably retaining two tennis balls for ready use by a player in a safe, convenient and economical manner.

Therefore, it can be appreciated that there exists a continuing need for a new and improved tennis ball holder which can be used for removably retaining two tennis balls for ready use by a player in a safe, convenient and economical manner. In this regard, the present invention substantially fulfills this need.

SUMMARY OF THE INVENTION

In view of the foregoing disadvantages inherent in the known types of game ball holders of known designs and configurations now present in the prior art, the present invention provides an improved tennis ball holder. As such, the general purpose of the present invention, which will be described subsequently in greater detail, is to provide a new and improved tennis ball holder and method which has all the advantages of the prior art and none of the disadvantages.

To attain this, the present invention essentially comprises a tennis ball holder. First provided is a housing assembly. The housing assembly has a lower extent. The housing assembly has an upper extent. The housing assembly has a maximum height of about 8.25 inches. The housing assembly has a maximum width of about 7.25 inches at a central elevational of the lower extent. The housing assembly has a front sheet. The housing assembly has a rear sheet. The rear sheet has a linear upper edge. The linear upper edge has a length of about 5 inches. The linear upper edge has ends. A curved convex periphery is provided for the majority of the lower extent. A curved concave periphery is provided for the majority of the upper extent between the periphery of the lower extent and the upper edge. The front sheet has an arcuate upper edge. The arcuate upper edge has a length of about 7.5 inches. The arcuate upper edge has ends intermediate the upper and lower extents. In this manner a passageway is formed. The front sheet also has a curved convex periphery for the entire lower extent. The curved convex periphery of the lower extent overlies the curved convex periphery of the rear sheet. A major binding is provided. The major binding extends from one end of the upper edge of the upper extent along the peripheries of the upper and lower extents to the other end of the upper edge of the upper extent. A minor binding is provided. The minor binding extends from one end of the upper edge of the lower extent to the other end of the upper edge of the lower extent.

A waist band is provided next. The waist band has a first end. The waist band has a second end. The waist band has an intermediate extent. The intermediate extent is provided between the first and second ends. The waist band has a slider. The slider is attached to the second end and the intermediate extent. In this manner a loop is formed. Further in this manner the length of the waist band is allowed to vary. The waist band has a clasp. The clasp has a first component. The first component is attached to the first end. The clasp has a separable second component. The separable second component is slidably attached to the loop. The waist band has stitching. The stitching secures the upper edge of the housing assembly to the intermediate extent of the band. The waist band has additional stitching. The additional stitching secures the binding of the housing assembly.

Further provided is a carrying case. The carrying case is adapted to carry the housing assembly. The carrying case has a circular front sheet. The carrying case has a similarly configured rear sheet. The carrying case has a binding. The carrying case has stitching. The stitching couples the majority of the peripheries of the front and rear sheets of the carrying case, a zipper separably coupling the minority of the peripheries of the front and rear sheets of the carrying case. The carrying case has a carrying strap. The carrying strap is provided above the zipper. The carrying strap is formed as an extension of the binding of the carrying case. The sheets of the housing assembly and the carrying case are fabricated of Ultrawick. Ultrawick is a synthetic fabric. Ultrawick has hydrophilic wicking properties. Ultrawick also has soil release properties. Ultrawick further has an antimicrobial finish. Ultrawick is a trademark of Game Time Performance Fabrics.

Provided last are two tennis balls. The tennis balls are removably positioned within the housing assembly. The tennis balls are adapted to be removed through the passageway. Additional tennis balls are adapted to be introduced into the housing assembly through the passageway.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved tennis ball holder which has all of the advantages of the prior art game ball holders of known designs and configurations and none of the disadvantages.

It is another object of the present invention to provide a new and improved tennis ball holder which may be easily and efficiently manufactured and marketed.

It is further object of the present invention to provide a new and improved tennis ball holder which is of durable and reliable constructions.

An even further object of the present invention is to provide a new and improved tennis ball holder which is susceptible of a low cost of manufacture with regard to both materials and labor, and which accordingly is then susceptible of low prices of sale to the consuming public, thereby making such tennis ball holder economically available to the buying public.

Even still another object of the present invention is to provide a tennis ball holder for removably retaining two tennis balls for ready use by a player in a safe, convenient and economical manner.

Lastly, it is an object of the present invention to provide a new and improved tennis ball holder. A housing assembly has a lower and an upper extent. The housing assembly has a front and a rear sheet. The rear sheet has an upper edge. The rear sheet has a curved periphery for the majority of the lower and upper extents. The front sheet overlies the majority of the rear sheet. The front sheet has an upper edge. In this manner a passageway is formed. A waist band has a clasp. The waist band has stitching. The stitching secures the upper edge of the housing assembly to the band.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a tennis ball holder constructed in accordance with the principles of the present invention.

FIG. 2 is a plan view of the tennis ball holder taken at line 2-2 of FIG. 1.

FIG. 3 is a cross sectional view of the tennis ball holder taken at line 3-3 of FIG. 1.

FIG. 4 is a front elevational view of a tennis ball holder constructed in accordance with an alternate embodiment of the present invention.

The same reference numerals refer to the same parts throughout the various Figures.

DESCRIPTION OF THE PREFERRED EMBODIMENT

Figure 5:
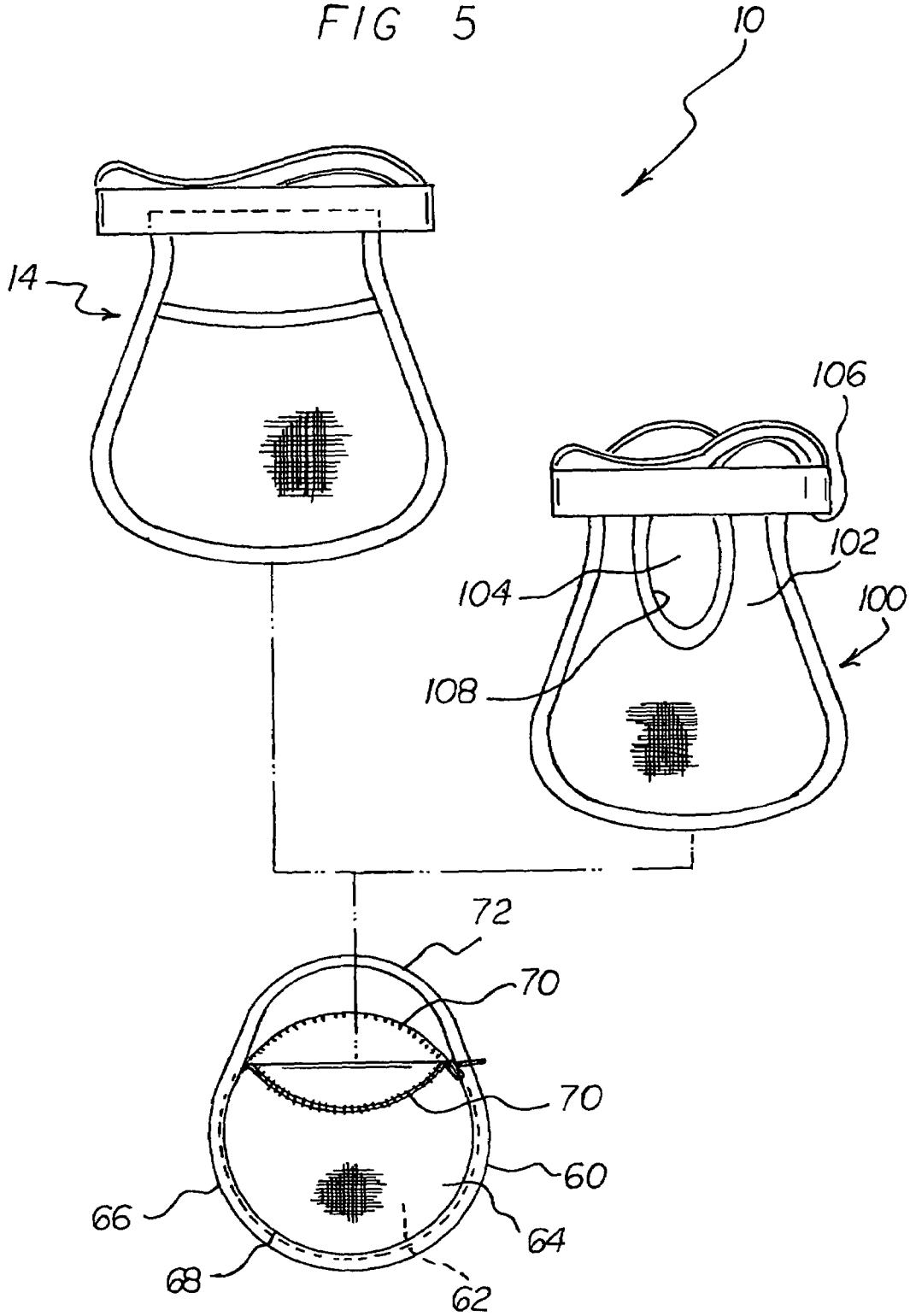
FIG. 5 as an exploded front elevational view of a tennis ball holder system constructed in accordance with the principles of the present invention.

With reference now to the drawings, and in particular to FIG. 1 thereof, the preferred embodiment of the new and improved tennis ball holder embodying the principles and concepts of the present invention and generally designated by the reference numeral 10 will be described.

The present invention, the tennis ball holder 10 is comprised of a plurality of components. Such components in their broadest context include a housing assembly and a waste band. Such components are individually configured and correlated with respect to each other so as to attain the desired objective.

First provided is a housing assembly 14. The housing assembly has a lower extent 16. The housing assembly has an upper extent 18. The housing assembly has a maximum height of about 8.25 inches. The housing assembly has a maximum width of about 7.25 inches at a central elevational of the lower extent. The housing assembly has a front sheet 20. The housing assembly has a rear sheet 22. The rear sheet has a linear upper edge 24. The linear upper edge has a length of about 5 inches. The linear upper edge has ends. A curved convex periphery 26 is provided for the majority of the lower extent. A curved concave periphery 28 is provided for the majority of the upper extent between the periphery of the lower extent and the upper edge. The front sheet has an arcuate upper edge 30. The arcuate upper edge has a length of about 7.5 inches. The arcuate upper edge has ends intermediate the upper and lower extents. In this manner a passageway is formed. The front sheet also has a curved convex periphery 32 for the entire lower extent. The curved convex periphery of the lower extent overlies the curved convex periphery of the rear sheet. A major binding 34 is provided. The major binding extends from one end of the upper edge of the upper extent along the peripheries of the upper and lower extents to the other end of the upper edge of the upper extent. A minor binding 36 is provided. The minor binding extends from one end of the upper edge of the lower extent to the other end of the upper edge of the lower extent.

A waist band 40 is provided next. The waist band has a first end 42. The waist band has a second end 44. The waist band has an intermediate extent. The intermediate extent is provided between the first and second ends. The waist band has a slider 46. The slider is attached to the second end and the intermediate extent. In this manner a loop 48 is formed. Further in this manner the length of the waist band is allowed to vary. The waist band has a clasp. The clasp has a first component 50. The first component is attached to the first end. The clasp has a separable second component 52. The separable second component is slidably attached to the loop. The waist band has stitching 54. The stitching secures the upper edge of the housing assembly to the intermediate extent of the band. The waist band has additional stitching 56. The additional stitching secures the binding of the housing assembly.

Further provided is a carrying case 60. The carrying case is adapted to carry the housing assembly. The carrying case has a circular front sheet 62. The carrying case has a similarly configured rear sheet 64. The carrying case has a binding 66. The carrying case has stitching 68. The stitching couples the majority of the peripheries of the front and rear sheets of the carrying case, a zipper 70 separably coupling the minority of the peripheries of the front and rear sheets of the carrying case. The carrying case has a carrying strap 72. The carrying strap is provided above the zipper. The carrying strap is formed as an extension of the binding of the carrying case. The sheets of the housing assembly and the carrying case are fabricated of Ultrawick. Ultrawick is a synthetic fabric. Ultrawick has hydrophilic wicking properties. Ultrawick also has soil release properties. Ultrawick further has an antimicrobial finish. Ultrawick is a trademark of Game Time Performance Fabrics.

Provided last are two tennis balls 74. The tennis balls are removably positioned within the housing assembly. The tennis balls are adapted to be removed through the passageway. Additional tennis balls are adapted to be introduced into the housing assembly through the passageway.

Reference is now made to the alternate embodiment of the invention illustrated in FIG. 4. A rear sheet 102 is provided. The rear sheet has upper and lower extents. The rear sheet has a linear upper edge. The rear sheet has a periphery. A front sheet 104 is provided. The front sheet has a discontinuous upper edge. A central portion extends downwardly a distance less than half the vertical height of the housing assembly in a U-shaped configuration. In this manner a passageway 106 is formed. A waist band 108 is provided. The waist band has a central extent. The waist band has stitching. The stitching couples the upper edges of the front and rear sheets to the waist band. Further included is a plurality of balls. The balls are provided within the housing assembly.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A tennis ball holder system for removably retaining two tennis balls for ready use by a player in a safe, convenient and economical manner comprising, in combination:

a housing assembly having a lower extent and an upper extent with a maximum height of about 8.25 inches and a maximum width of about 7.25 inches at a central elevational of the lower extent, the housing assembly being constructed of a front sheet and a rear sheet, the rear sheet having a linear upper edge with a length of about 5 inches with ends and a curved convex periphery for the majority of the lower extent and a curved concave periphery for the majority of the upper extent between the periphery of the lower extent and the upper edge, the front sheet having an arcuate upper edge having a length of about 7.5 inches with ends intermediate the upper and lower extents to form a passageway, the front sheet also having a curved convex periphery for the entire lower extent overlying the curved convex periphery of the rear sheet, a major binding extending from one end of the upper edge of the upper extent along the peripheries of the upper and lower extents to the other end of the upper edge of the upper extent, a minor binding extending from one end of the upper edge of the lower extent to the other end of the upper edge of the lower extent;

a waist band having a first end and a second end and an intermediate extent there between, a slider attached to the second end and the intermediate extent for forming a loop and to allow varying the length of the waist band, a clasp having a first component attached to the first end and a separable second component slidably attached to the loop, stitching securing the upper edge of the housing assembly to the intermediate extent of the band with additional stitching securing the binding of the housing assembly;

a carrying case adapted to carry the housing assembly and having a circular front sheet and a similarly configured rear sheet with a binding and stitching coupling the majority of the peripheries of the front and rear sheets of the carrying case, a zipper separably coupling the minority of the peripheries of the front and rear sheets of the carrying case, a carrying strap above the zipper and formed as an extension of the binding of the carrying case, the sheets of the housing assembly and the carrying case being fabricated of a synthetic fabric with hydrophilic wicking properties along with soil release properties and an antimicrobial finish; and two tennis balls removably positioned within the housing assembly, the tennis balls adapted to be removed through the passageway and, additional tennis balls adapted to be introduced into the housing assembly through the passageway.

* * * * *